United States Patent [19]

Anthony et al.

[11] 4,394,019

[45] Jul. 19, 1983

[54] OIL DRILLING GAME BOARD

[75] Inventors: James R. Anthony; David M. Rush, both of Indianapolis, Ind.

[73] Assignee: Antfamco, Inc., Carmel, Ind.

[21] Appl. No.: 255,159

[22] Filed: Apr. 17, 1981

[51] Int. Cl.[3] ..... A63F 3/00

[52] U.S. Cl. ..... 273/256

[58] Field of Search ..... 273/254, 256, 273, 287, 273/289; 248/558

[56] References Cited

U.S. PATENT DOCUMENTS

| | | | |
|---|---|---|---|
| 2,026,082 | 12/1935 | Darrow | 273/256 |
| 2,299,803 | 10/1942 | Deaton | 273/278 |
| 2,750,709 | 6/1956 | Saverino | 248/188.2 |
| 3,729,198 | 4/1973 | Shaffer | 273/254 |
| 3,801,104 | 4/1974 | Potts | 273/256 |
| 3,844,567 | 10/1974 | Marker | 273/254 |
| 4,025,075 | 5/1977 | Priska | 273/289 |

*Primary Examiner*—Richard J. Apley
*Assistant Examiner*—R. C. Moy
*Attorney, Agent, or Firm*—Woodard, Weikart, Emhardt & Naughton

[57] ABSTRACT

A game board simulating an oil well field. The game board has a hollow interior with a plurality of movable elements positioned therein. A plurality of holes are provided on the game board playing surface simulating oil wells and leading into the hollow interior. An oil well derrick has a plunger extendable through the oil well holes to contact the movable elements located therebeneath. A plurality of oil well properties are positioned around the periphery of the game board and arranged in a path to be followed by player tokens. The properties are grouped into families of properties. The playing surface is colored in different regions with each region associated with a particular family of properties simulating oil well fields associated with a particular property.

4 Claims, 13 Drawing Figures

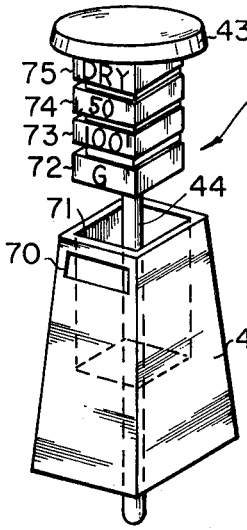
Fig.3
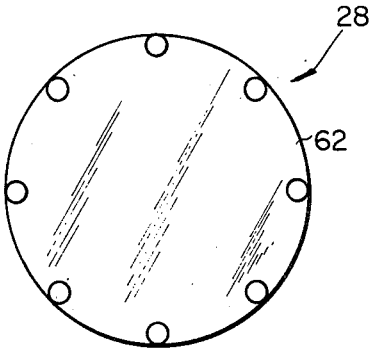
Fig.4
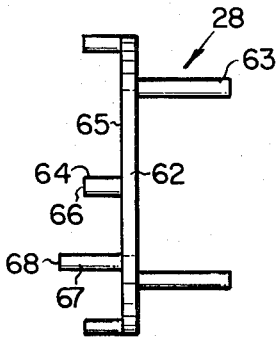
Fig.5
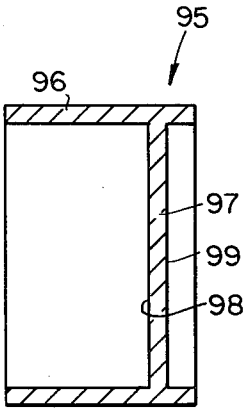
Fig. 6
60
QUICK CALCULATION CHART
TO DETERMINE ROYALTY DUE . . . ADD NUMBERS ON ANY PRODUCING WELLS PLUS (1) FOR EACH LEASE NUMBERS. SIMPLY SELECT DOLLAR AMOUNT OPPOSITE THE NUMBER TOTAL. MORTGAGE VALUE CAN BE DETERMINED IN THE SAME MANNER
| NO. = | $ | | | | | | | |
|---|---|---|---|---|---|---|---|---|
| 1 = | 250 | | | | | | | |
| 2 = | 500 | | | | | | | |
| 3 = | 750 | | | | | | | |
| 4 = | 1,000 | | | | | | | |
| 5 = | 1,250 | | | | | | | |
| 6 = | 1,500 | | | | | | | |
| 7 = | 1,750 | | | | | | | |
| 8 = | 2,000 | | | | | | | |
| 9 = | 2,250 | | | | | | | |
| 10 = | 2,500 | | | | | | | |
Fig.7

OIL DRILLING GAME BOARD

BACKGROUND OF THE INVENTION

This invention is in the field of games and those more specifically having game boards with a playing surface thereon. A number of United States patents have been granted on such game boards including U.S. Pat. Nos. 4,216,967 and 4,109,917 both having maps drawn on the playing surface and U.S. Pat. No. 3,565,437 having a continuous path surrounding the periphery of the board depicting various types of purchases. Disclosed herein is yet another game board having several advantages as compared to the prior games. First, the game combines not only a player's skill but also the factor of chance. A plurality of movable elements are located beneath the game board and are contactable as the player extends a plunger or member through the game board to the hollow interior. The movable objects are distributed at random and must be contacted in order for the player to win the game. Further, the game is directed towards the general subject of oil or petroleum providing a subject of topical interest.

SUMMARY OF THE INVENTION

One embodiment of the present invention is an oil well drilling game comprising a game board having a hollow interior and a playing surface thereabove, the playing surface having marked thereon a plurality of oil properties with each property having associated therewith oil well holes extending through the playing surface into the interior, a plurality of movable oil well bodies within the interior, the bodies having contact surfaces spaced from the playing surfaces different distances associated with the amount of oil for a given oil well, and oil drilling means extendable through to drill any of the holes and operable to contact any of the contact surfaces located therebeneath to indicate the amount of oil for a given oil well.

Another embodiment of the present invention is a game comprising a game board with a top playing surface having a plurality of holes extending therethrough and support means operable to support said playing surface atop and apart from a support, a plurality of elements movable at random and spaced apart from the playing surface different distances while positioned between the support and playing surface, and second means movable across and atop the playing surface and extendable into the holes to contact the elements by chance.

It is an object of the present invention to provide a game incorporating the player's skill along with the factor of chance.

A further object of the present invention is to provide a new and improved game board directed to the subject of oil.

A further object of the present invention is to provide a game board having a hollow interior with movable objects therein contactable by elements extendable through the game board.

Related objects and advantages of the present invention will be apparent from the following description.

BRIEF DESCRIPTION OF THE DRAWINGS

FIG. 3 is a perspective view of the oil derrick used to drill the holes of the game board in FIG. 1.

FIG. 4 is a top view of one of the movable elements 28 housed within the game board.

FIG. 5 is a side view of the element of FIG. 4.

FIG. 6 is a cross-sectional view of an alternate embodiment of the movable element.

FIG. 7 is a top view of the quick calculation chart.

DESCRIPTION OF THE PREFERRED EMBODIMENT

Figure 1:
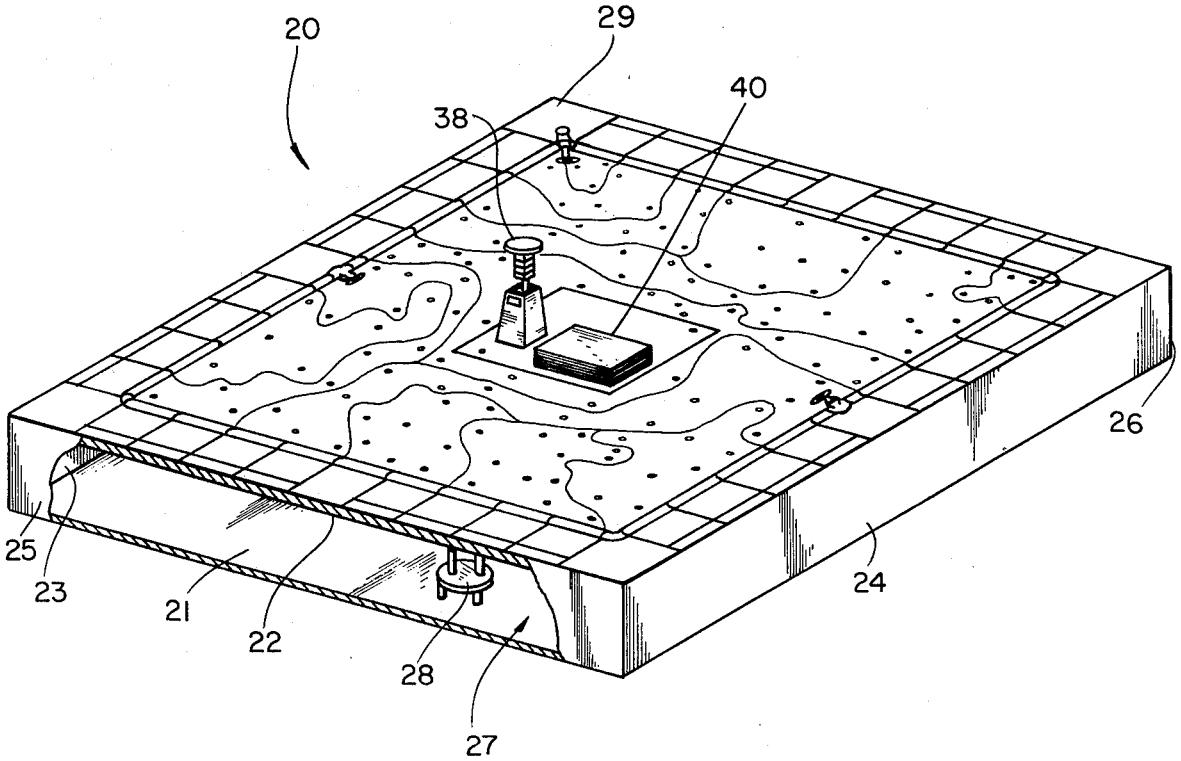
FIG. 1 is a fragmentary perspective view of the game board incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a game board 20 having a general box-like configuration including a bottom wall 21 and top wall 22 joined together by a pair of side walls 23 and 24 along with a pair of end walls 25 and 26. Walls 21 through 26 are spaced apart forming a hollow interior 27 in which a plurality of movable elements 28 are positioned atop and supported by bottom wall 21. The upwardly facing surface 29 of top wall 22 provides a playing surface shown in more detail in FIGS. 2*a*, 2*b*, 2*c* and 2*d*.

FIGS. 2*a*, 2*b*, 2*c* and 2*d* are fragmentary views of the four quadrants of the game board. That is, the right side of FIG. 2*b* abuts the left side of FIG. 2*a* whereas the right side of FIG. 2*c* abuts the left side of FIG. 2*d*. Likewise the bottom sides of FIGS. 2*c* and 2*d* abut respectively the top sides of FIGS. 2*b* and 2*a*.

Figure 2A:
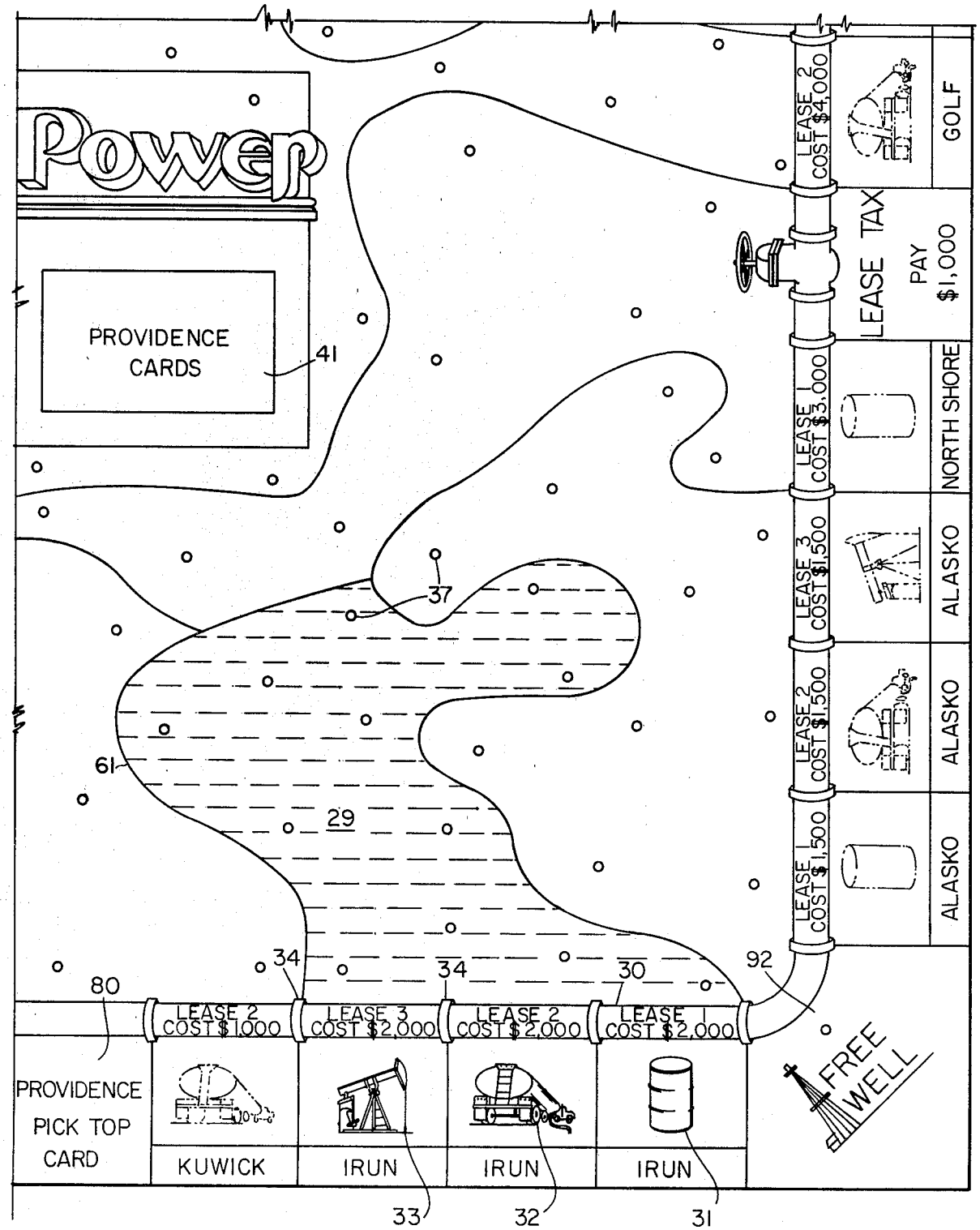
FIGS. 2*a* through 2*d* are fragmentary top plan views of the playing surface of the board of FIG. 1 and arrangeable into a single figure.
Figure 2B:
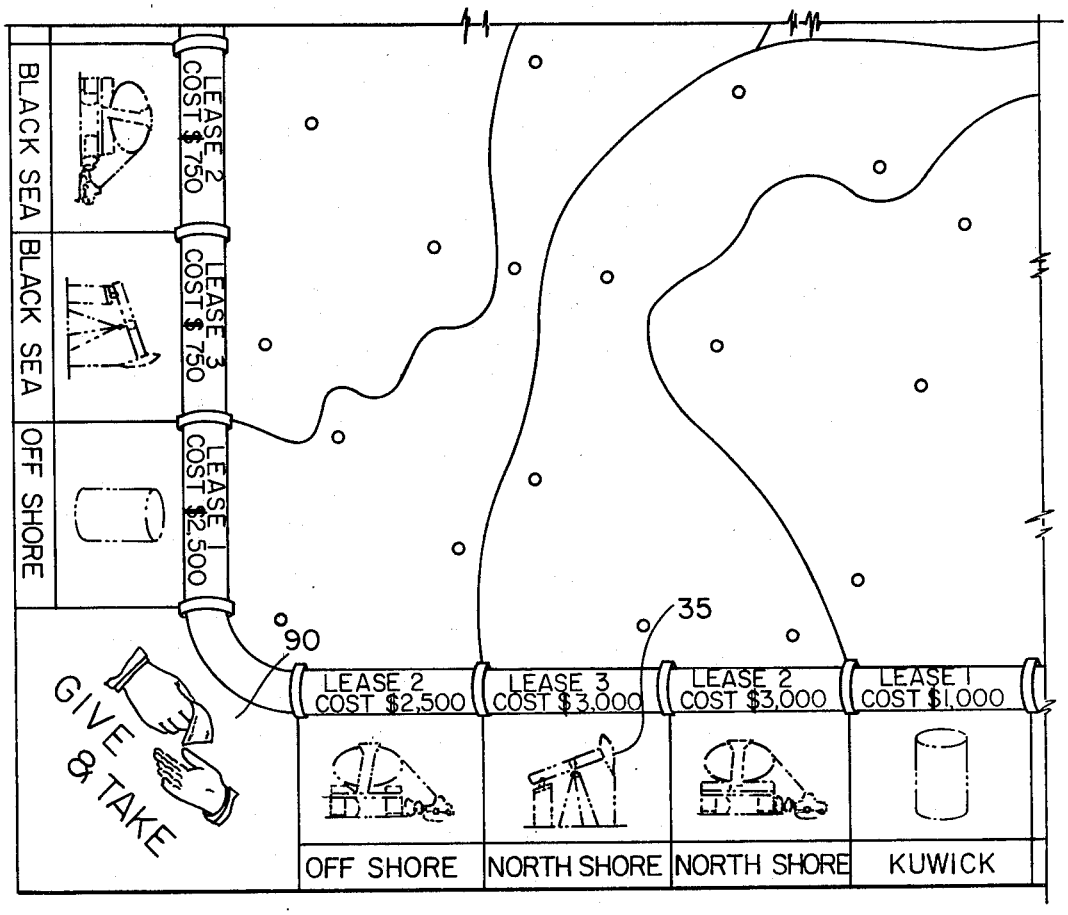
Figure 2C:
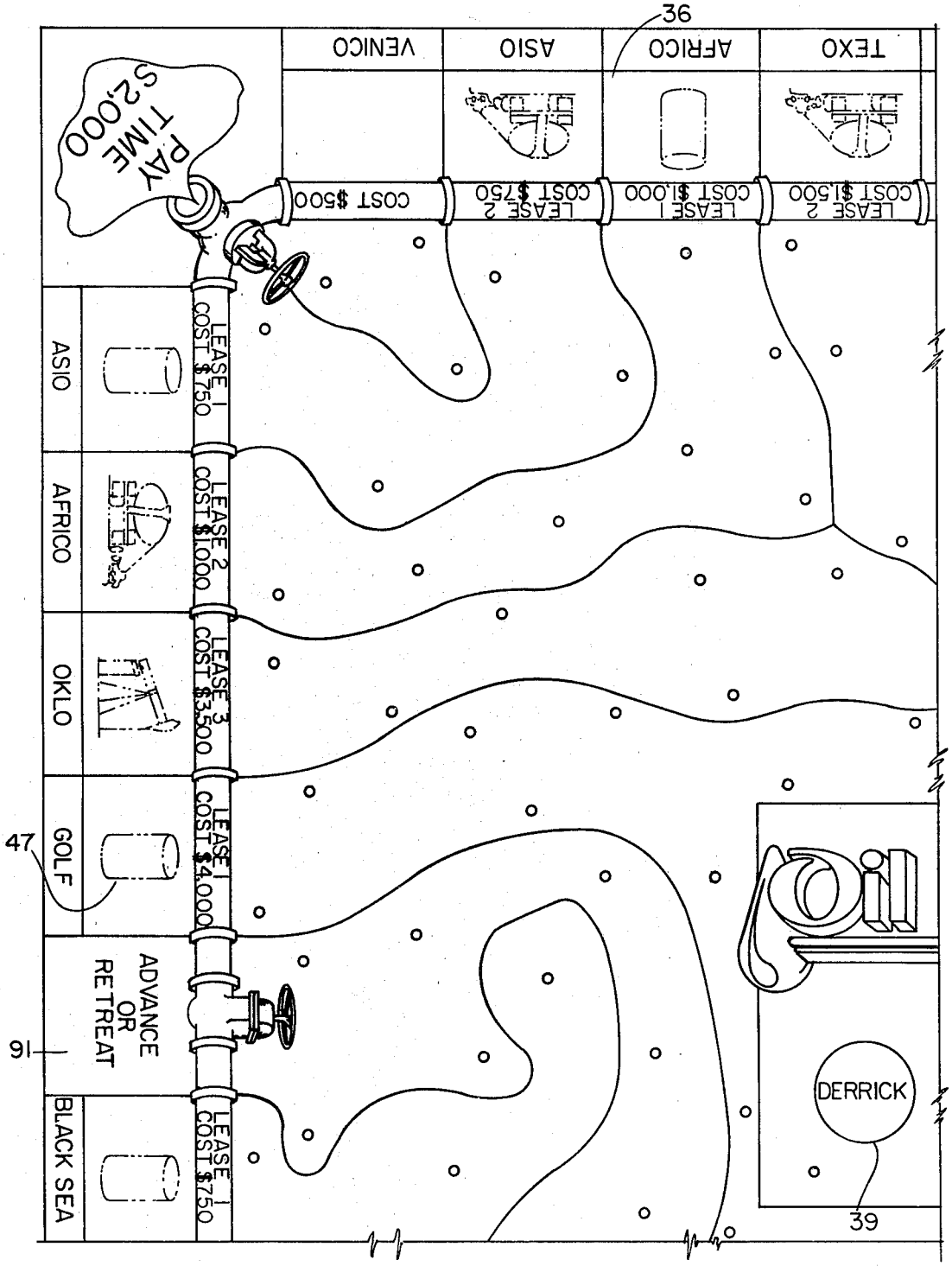
Figure 2D:
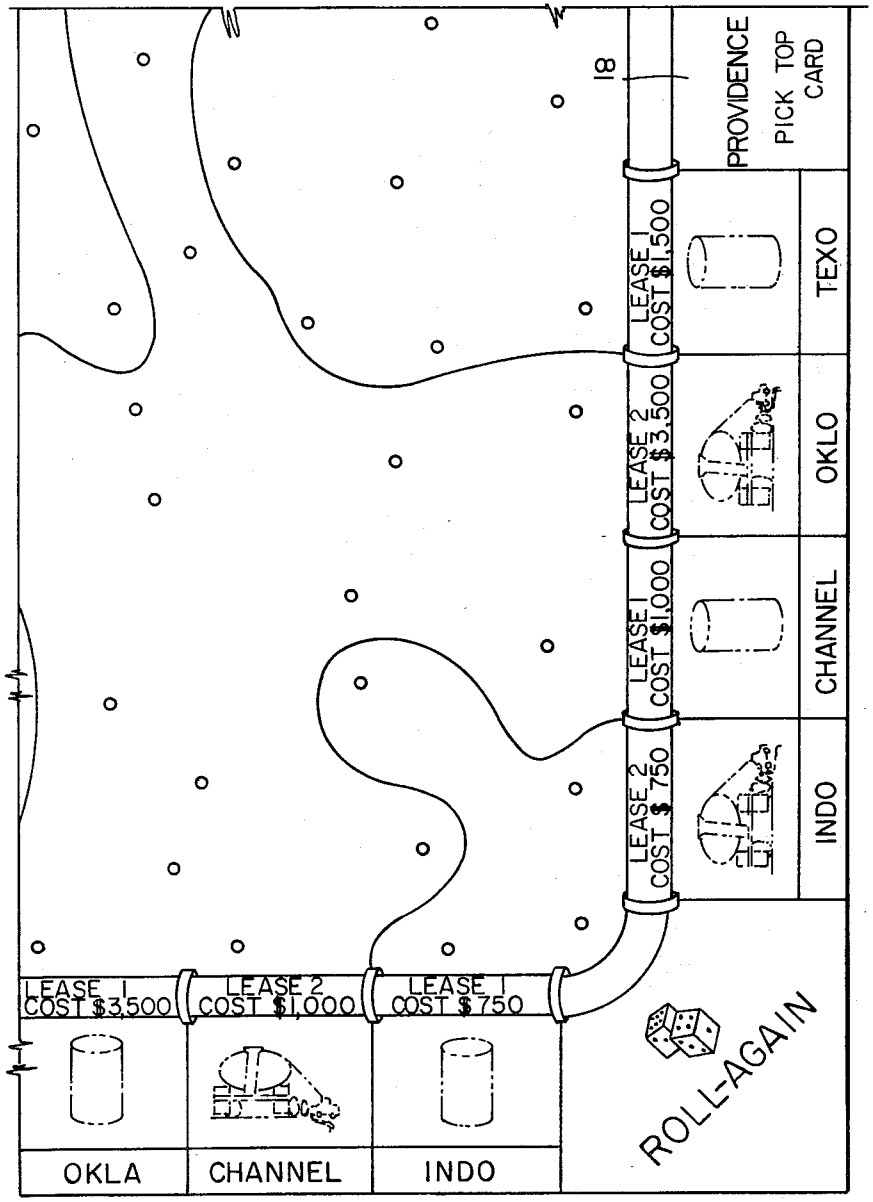

Depicted on playing surfaces 29 is a continuous pipeline 30 spaced inwardly from the periphery of the board. Located between the periphery of the board and pipeline 30 are a plurality of different properties identified by the same name. For example, the family of properties identified by the name Irun (FIG. 2*a*) include three separate properties shown by the illustrations of a barrel 31, an oil truck 32 and a oil pump 33. Fittings 34 separate one property from another property. In addition, the cost of a lease associated with each property is printed on pipeline 30 immediately adjacent to the associated property. Other families of properties are located around the periphery of the board and include for example the North Shore properties 35 (FIG. 2B) and the Africo properties 36 (FIG. 2*c*).

A plurality of holes 37 (FIG. 2*a*) extend through playing surface 29 to the hollow interior 27 of the game board. A derrick 38 (FIG. 1) having a movable plunger is initially positioned upon area 39 (FIG. 2*c*) and may be moved to the appropriate hole 37 for the drilling operation. In addition, a plurality of providence or chance cards 40 (FIG. 1) are located in area 41 (FIG. 2*a*) and are chosen by players as to be described later.

Derrick 38 (FIG. 3) includes a truncated triangular configured main body 42 having a central passage extending therethrough slidably receiving rod 44 attached to plunger head 43. Rod 44 is sufficiently long so as to extend beneath main body 42 as plunger 43 is forced downwardly with the bottom end of rod 44 extending through the appropriate hole 37 and into hollow interior 27 to contact any movable object 28 located at random therebeneath.

Figure 8:
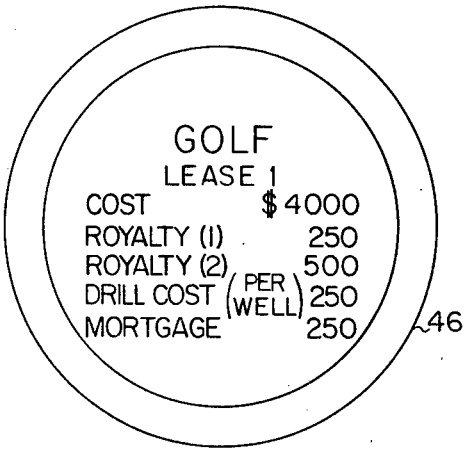
FIG. 8 is a top view of one of the lease deed cards.
Figure 9:
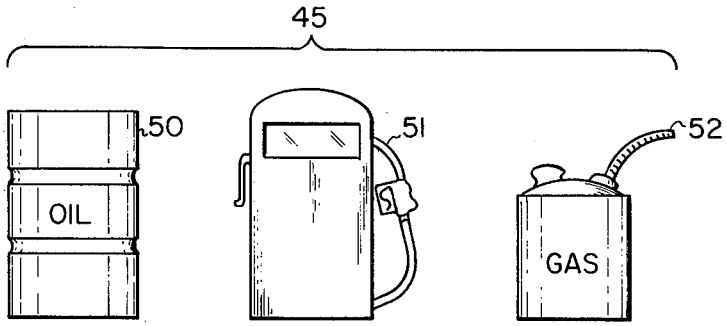
FIG. 9 is a view of the player tokens.

In addition to the previous elements of the game described, there is provided a plurality of individual tokens 45 (FIG. 9) with each token assigned to a separate player and indicating the player's position around the periphery of the board. Further, a separate deed card 46 (FIG. 8) is provided for each separate property displayed on the playing surface 29. For example, deed card 46 is associated with property 47 (FIG. 2*c*) identifying lease 1 of the family of properties under the term GOLF. The second lease for the GOLF properties is shown in FIG. 2*a*. Deed card 46 provides information concerning the cost of the lease along with the royalties, drilling costs and mortgage amount. In addition, an ample supply of play money is provided with a specified amount assigned to each player.

The object of the game is to become the richest player by buying or selling oil leases, drilling wells on the lease and collecting lease royalties. Prior to the start of the game, board 20 is shaken briskly from side to side to distribute elements 28 at random beneath the playing surface. Each element 28 represents a separate oil pool located under holes 37. The playing board 20 should then be placed on a table and care should be taken not to bump or reshake the board so as to prevent movement of the elements or oil pools 28. Next, each player must select one of the playing pieces or tokens depicted in FIG. 9. For example, one player may have a token configured as a barrel 50, another player having a gas pump configured token 51 and a third player having a gas can configured token 52. The drilling derrick 38 is then positioned atop area 39 with the providence cards 40 being shuffled and placed in a stack atop area 41. The cards may be of different colors such as yellow and blue. As a suggestion, each player is then issued approximately $20,000 in play money and distributed in denominations including $5,000, $1,000, $500, $250, $100 and $50 bills. The lease cards 46 associated with each property along with the remaining money and tokens are then given to a person serving as the bank and should be organized for quick access as needed.

One of the players or a spectator must be designated as the banker who must keep his funds separate from the bank funds. The transactions and functions of the bank include the following: payout funds such as required for time payments, collect taxes and fines, collect payments for leases and issue oil lease cards, collect payment for oil well drilling and provide appropriate oil pumpers or dry hole markers, payout funds for mortgages, receive funds for mortgage payoffs and auction off any leases acquired because of bankruptcy.

Any number of players can play the subject game; however, two to four players are the ideal number. Each player throws a pair of dice and the player with the highest number starts by placing his or her marker or token (FIG. 9) at the corner of the board indicated as "Pay Time $2,000." The player then moves his or her marker the number of spaces shown on the dice. Other players proceed after the first party has completed his or her play passing from left to right or in the words following a path from FIG. 2*c* to FIG. 2*d* to FIG. 2*a* to FIG. 2*b* to FIG. 2*c* etc. More than one marker may sit on a space at a time. Markers proceed from their last space each time a player's next turn is in order and move clockwise around the playing board.

A player may buy the lease rights to an unowned lease on which he or she lands and likewise may be obliged to pay lease royalties, taxes, fines, draw providence cards ect. for each place his marker lands on. When a player rolls doubles the player is entitled to roll again up to three rolls of doubles. Whenever a player's mark passes the block identified as "Pay Time $2,000," he will receive $2,000 from the bank.

A player may purchase the lease rights to any property to which he lands which is not already owned by another player. The player may also decline to purchase the lease. The funds required to buy the lease are paid to the bank and the banker issues the oil lease card (FIG. 8) which should be kept face up in front of the owner.

A player landing on a lease owned by someone else must pay as a royalty to the lease owner the amount shown on the lease card. If active wells are on the property, additional royalties must be paid with the schedule of the amounts to be paid shown on the quick calculation chart 60 shown in FIG. 7. The quick calculation chart will speed up determination of amounts due. If a person fails to see someone on their lease until after the next person has rolled then the player forfeits their right to collect royalties.

A player who has purchased all the spaces to a family of leases may drill for oil by paying the bank the amount indicated on the lease card. For example, a player having landed on properties 31, 32 and 33 and having paid the bank on three separate occasions each lease amount which is $2,000 would have the right drill any of the holes located within the colored area 61 associated with the family of properties identified by the term Irun. Each separate family of properties has its own specified colored area on playing surface 29 indicating the field of oil associated with the properties. For illustration purposes, area 61 is shown in the drawings as having dashed lines to more clearly depict the boundaries of area 61. On an actual board area 61 will be depicted in a solid color with the remaining areas or fields associated with other families of property depicted by other colors. Each oil field is defined by lines which terminate at the oil pipe 30.

A well is drilled by placing derrick 38 over any drilling site represented by one of the holes 37 located within colored area 61. The drill shaft or rod 44 is then pushed down until the rod stops. In the event one of the movable elements 28 are not located beneath the particular hole drilled, then rod 44 will contact bottom wall 21 (FIG. 1) indicating that the hole is a dry well. On the other hand, in the event one of the movable elements 28 is located beneath the particular hole drill then rod 44 will contact one of the top surfaces of the movable element indicating oil within the hole.

Referring to FIGS. 4 and 5 one of the elements 28 is depicted as having a main body 62 integrally attached to and supported by a plurality of legs 63 resting atop the bottom wall 21 of the game. A plurality of upwardly extending legs 64 and 67 are integrally attached to main body 65 having respectively upper surfaces 66 and 68.

Oil derrick 38 is designed to indicate four different conditions associated with a particular hole 37. In the event a movable element 28 is not located below the particular hole drilled, then rod 44 will bottom against wall 21 of the game board. If a movable element 28 is located beneath the hole being drilled, then rod 44 will contact surface 65, 66 or 68. In either event, rod 44 would not extend all the way to bottom wall 21 and would therefore indicate oil within the well. Derrick 38 is designed to indicate one of four conditions for a particular hole 37 drilled by the derrick. The four conditions being that the hole is a dry hole, or a hole having oil therein such as a fifty barrels per day, one hundred barrel per day or a gusher. A window 70 is provided on main body 42 (FIG. 3) allowing the player to see into recess 71 which complementarily receives the enlarged sections 72, 73, 74 and 75. In the event that rod 44 contacts surface 68 of rod 67, then element 72 is positioned adjacent window 70 with the letter "G" indicating a gusher hole. Likewise, in the event rod 44 contacts either surfaces 66 or 65, then portions 73 and 74 would respectively be provided within the window 70 indicating either a one hundred barrel per day hole or a fifty barrel per day hole. Extension or rod 44 against wall 21 will automatically position portion 75 within window 70 indicating a dry hole.

Figure 10:
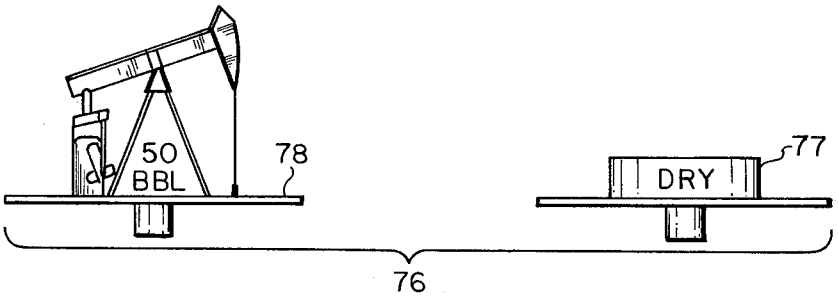
FIG. 10 is a side view of the oil well markers.

Well pumpers or dry hole markers 76 (FIG. 10) are provided to be positioned over a hole 37 drilled by derrick 38. The markers include either a dry hole marker 77 or a well pumper 78. Both markers 77 and pumper 78 have a main body with a projection extending therebeneath to fit into hole 37. Atop the main body of marker 77 and pump 78 is suitable indicia to indicate either that the well is dry or a fifty barrel, one hundred barrel or gusher oil hole. Once a hole has been drilled and a marker or pumper inserted into the drilled hole, then a player is prohibited from redrilling the particular hole unless the markers and pumpers are removed as described later in this specification.

Only one well may be drilled per turn unless the player rolls doubles in which event the player may drill on each successive roll if the player pays and drills in advance of each roll up to a maximum of three times. The player may also drill more than once in the event the player lands on the areas 80 (FIG. 2*a*) and 81 (FIG. 2*d*) requiring the player to pick one of the providence cards 40 which in certain instances may direct the player to drill an extra hole. The remaining providence cards direct the player to certain locations on the board.

Different amount of royalties are required depending upon whether a hole is a dry hole, a fifty barrel well, a one hundred barrel well or a gusher. Zero royalties are required for a dry hole, $250 for each fifty barrel well, $500 for each one hundred barrel well and $1250 for each gusher. To determine the royalty due, the number of any producing wells on the family of properties should be added together plus one for each lease number. The dollar amount opposite the total number indicated on the quick calculation chart of FIG. 7 then provides the amount of royalty due. The mortgage value may be determined in the same manner. For example, in the event Player A owns properties 31, 32 and 33 and has drilled four holes thereon resulting in a dry hole, a fifty barrel well, a one hundred barrel well, and a gusher, then if Player B lands on property 32, the royalty may be calculated as follows: the number of leases (three) in the family must be added with zero for the dry hole, one for the fifty barrel well, two for the one hundred barrel well, and five for the gusher well resulting in a total of eleven. That is, three for the total number of leases, and eight for the combination of the three wells resulting in a total royalty due of $2,750 to be paid by Player B to Player A.

If a player has lease spaces of a particular family of properties, the player may mortgage the unimproved leases and receive the amount shown on the lease card. If there are producing wells in the lease, additional mortgage money can be secured. Wells and spaces cannot be mortgaged at a time. All spaces of a family plus the wells thereon must be mortgaged together. Mortgage values are as follows: zero dollars for each dry hole, $250 for each fifty barrel well, $500 for each hundred barrel well, $1250 for each gusher. The quick calculation chart will help each player to quickly figure mortgage amounts due. No royalties can be collected on wells or leases while a lease is mortgaged and the lease card must be turned face down by the player. A player may buy back his mortgage lease and wells for the same amount the player received plus a $1,000 interest but only on the player's turn. Further, a player with mortgage property may not drill new wells until the lease and wells are unmortgaged. The stack of providence cards 40 may be printed in two colors. A player selects the top card on the deck when the player lands on either space 80 or 81. A player selects the top card when the player lands on space 80 or 81 and must then follow the instructions on the card. In the event the color is yellow then the player may refuse to take the card whereas a blue card must be taken if the player lands on either space 80 or 81. The card is placed on the bottom of the deck after the requested action is completed.

If a player lands on space 90 (FIG. 2*b*) indicating "Give and Take," the player must then roll the dice and receive or pay to the bank the following amount: $1,000 to the bank if the total of both dice is under six whereas the bank will pay the player $1,000 if the total sum of the dice is six or over.

If a player lands on space 91 (FIG. 2*c*) indicated as advance or retreat, then the player again rolls the dice and moves his token backward the number of spaces rolled if the sum of the dice is under six whereas the token is moved forward the number indicated on the dice if the total number is six or over.

If a player lands on space 92 (FIG. 2*a*) indicated as "Free Well" then the player may drill a well in addition to the well normally allowable on a player's dice roll. If the player lands on space 92 and does not have any leases then his token is simply left on space 92 until the player's next turn. The holes 37 associated with space 92 may be drilled only when the player is instructed to by a card from stack 40.

Private transactions may be made between two players for the sale or trade of unimproved leases or providence cards for whatever cash and property is agreed upon. Trade can only be made on undrilled leases and when it is one of the trading party's turn. Further, no player can loan or borrow from another player and the bank is the only party who can extend funds to a player by mortgage.

A player is bankrupt whenever the player cannot pay the bank or another player what is owed. When this occurs, a player must forfeit everything the player has to whomever the player cannot pay. If the leases go to the bank, the bank can auction the leases to the highest bidder but all producing wells must be moved first. The buyer can then activate the wells for the normal charge at the normal rate. If the leases go directly to another player, then the player may unmortgage the properties and wells for the normal amount when it is the player's turn.

Before starting the game, the players should decide on how long to play or when the game automatically stops. Three methods of ending the game include playing for a set period of time (one hour) after the first bankruptcy or after the second bankrupty.

The richest player is the winner when the game ends. Valuation of leases and producing wells can be calculated by using the quick calculation chart. The leases are valued at the cost of all lease spaces owned whereas the producing wells are in accordance with the quick calculation chart.

Many variations in the subject game are contemplated and included herein. For example, an alternate embodiment of the movable elements beneath the playing surface would include an element shown in cross section in FIG. 6. Element 95 includes a cylindrical continuous side wall 96 integrally joined to a wall 97 perpendicular arranged thereto. Element 95 is hollow allowing the derrick rod to extend down to contact either surface 98 or 99 depending upon which surface is facing upward. A further variation of the movable elements includes varying the diameters of the movable elements. For example, element 95 may be produced in a two inch diameter, three inch diameter and four inch diameter. Thus as the elements are shaken within the game board prior to the start of the game, the different diameter elements will be located at random beneath the holes 37. Thus, when a player drills a particular hole contacting an element, then the player will be unsure whether drilling of the adjacent hole will likewise result in contacting an element due to the different diameters of elements. A number of elements 95 may be placed beneath the playing surface. For example four elements 95 of four inch diameter, three elements 95 of three inch diameter, and two elements 95 of two inch diameter may be utilized.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An oil well drilling game comprising:

a game board having a hollow interior and a playing surface thereabove, said playing surface having marked thereon a plurality of oil properties with each property having associated therewith oil well holes extending through said playing surface into said interior;

a plurality of movable oil well bodies within said interior, said bodies having contact surfaces spaced from said playing surfaces different distances associated with the amount of oil for a given oil well; and oil drilling means extendable through to drill any of said holes and operable to contact any of said contact surfaces located therebeneath to indicate the amount of oil for a given oil well and wherein:

said game board has a circumferentially extending edge portion defining a continuous playing path with said properties positioned on said circumferentially extending edge portion and grouped into different categories, said game board has a center portion surrounded by said edge portion with said oil well holes located in said center portion and grouped into separate oil well holes located in said center portion and grouped into separate oil field regions providing a separate region for each of said categories, said oil field regions are contiguous with spaces of the particular category associated therewith, at least one of said categories have multiple non-adjacent properties located on said edge portion and contiguous with one of said regions which extends across said center portion between opposite edge portions.

2. An oil well drilling game comprising:

a game board having a hollow interior and a playing surface thereabove, said playing surface having marked thereon a plurality of oil properties with each property having associated therewith oil well holes extending through said playing surface into said interior;

a plurality of movable oil well bodies within said interior, said bodies having contact surfaces spaced from said playing surfaces different distances associated with the amount of oil for a given oil well; and oil drilling means extendable through to drill any of said holes and operable to contact any of said contact surfaces located therebeneath to indicate the amount of oil for a given oil well and wherein:

said game board has a circumferentially extending edge portion defining a continuous playing path with said properties positioned on said circumferentially extending edge portion and grouped into different categories, said game board has a center portion surrounded by said edge portion with said oil well holes located in said center portion and grouped into separate oil field regions providing a separate region for each of said categories, said oil field regions are contiguous with spaces of the particular category associated therewith, at least one of said categories have multiple adjacent properties located on said edge portion and contiguous with one of said regions, at least one of said categories have multiple non-adjacent properties located on said edge portion and contiguous with one of said regions which extends across said center portion between opposite edge portions.

3. The oil well drilling game of claim 1 and further comprising:

a plurality of markers positionable adjacent any of said oil well holes drilled by said oil drilling means to indicate the amount of oil associated therewith;

a plurality of property cards each associated with one of said properties and having assigned thereon an individual cost of said one property.

4. The oil well drilling game of claim 2 wherein:

said oil well bodies including a thin wall with a first contact surface and an oppositely facing second contact surface and further including a first support perpendicularly arranged and integrally connected to said wall supporting said wall a first distance apart from said playing surface when said first contact surface faces upwardly and further including a second support perpendicularly arranged and integrally connected to said wall supporting said wall a second distance apart from said playing surface unequal to said first distance when said second contact surface faces upwardly allowing the same oil well body to represent different distances associated with the amount of oil for a given oil well depending on which contact surface faces upwardly.

* * * * *